United States Patent [19]

Kiss

[11] 4,246,573

[45] Jan. 20, 1981

[54] PROTECTION SYSTEM FOR ELECTRONIC GEAR

[76] Inventor: Laszlo A. Kiss, 23 Carver La., Sunol, Calif. 94536

[21] Appl. No.: 903,245

[22] Filed: May 5, 1978

Related U.S. Application Data

[63] Continuation-in-part of Ser. No. 726,273, Sep. 24, 1976, abandoned.

[51] Int. Cl.[3] ..... G08B 1/08; H04K 1/00

[52] U.S. Cl. ..... 340/539; 340/63; 340/568; 340/571; 375/2; 455/1; 455/26; 455/89

[58] Field of Search ..... 340/539, 63, 64, 65, 340/568, 571, 572; 325/15, 22, 25, 57, 55, 64, 159, 312, 353, 132, 32, 31, 16, 152; 375/2, 4; 455/1, 26, 30, 54, 58, 67, 73, 89, 95, 99, 115

[56] References Cited

U.S. PATENT DOCUMENTS

| | | | |
|---|---|---|---|
| 2,541,461 | 2/1951 | Churchill | 340/542 |
| 3,161,829 | 12/1964 | Schulman | 325/152 |
| 3,387,101 | 6/1968 | Skiles | 325/166 |
| 3,755,776 | 8/1973 | Kotras | 340/63 |
| 4,067,411 | 1/1978 | Conley et al. | 340/63 |
| 4,145,655 | 3/1979 | Caudel et al. | 325/15 |

*Primary Examiner*—John W. Caldwell, Sr.
*Assistant Examiner*—Donnie L. Crosland
*Attorney, Agent, or Firm*—Flehr, Hohbach, Test et al

[57] ABSTRACT

A system for use in combination with (for electrical attachment to) electronic gear having an audio amplifier and which includes alarm means for generating a theft signal which is broadcast through a transmitter or audio system thereof and internal coded disable means for disabling the alarm upon insertion into the system of a predetermined coincidence signal that is substantially unique for each individual unit protected.

13 Claims, 6 Drawing Figures

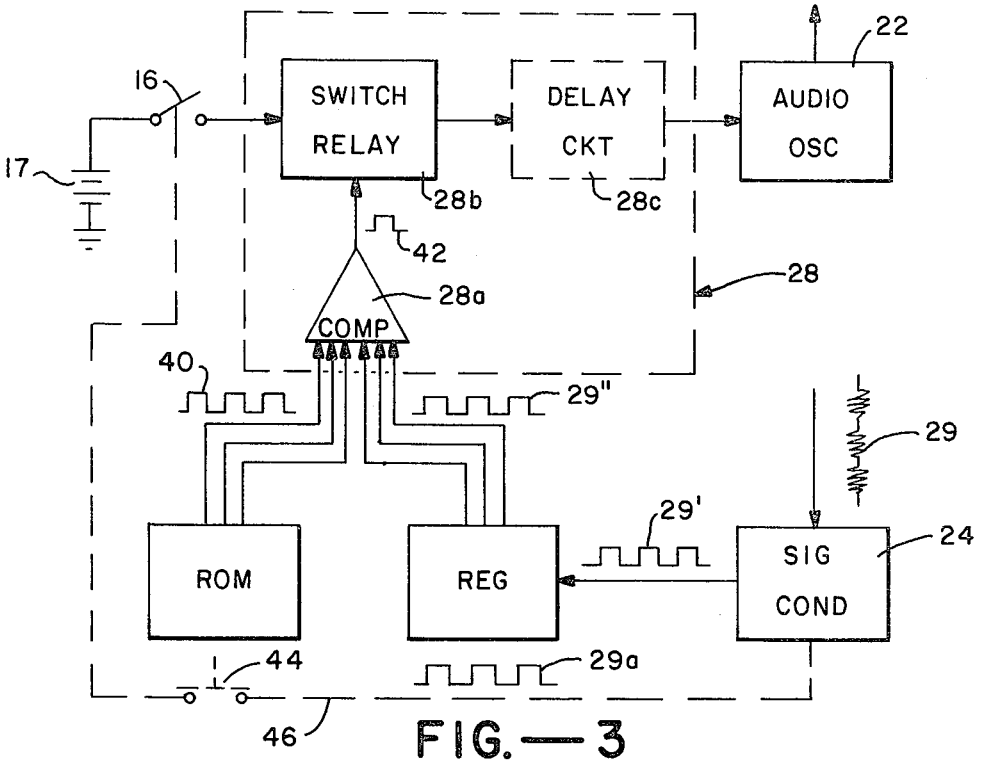
FIG.—3
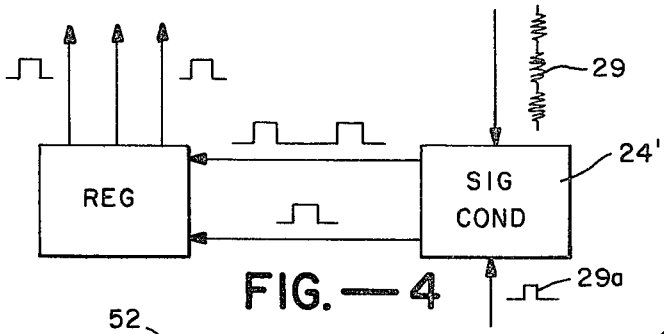
FIG.—4
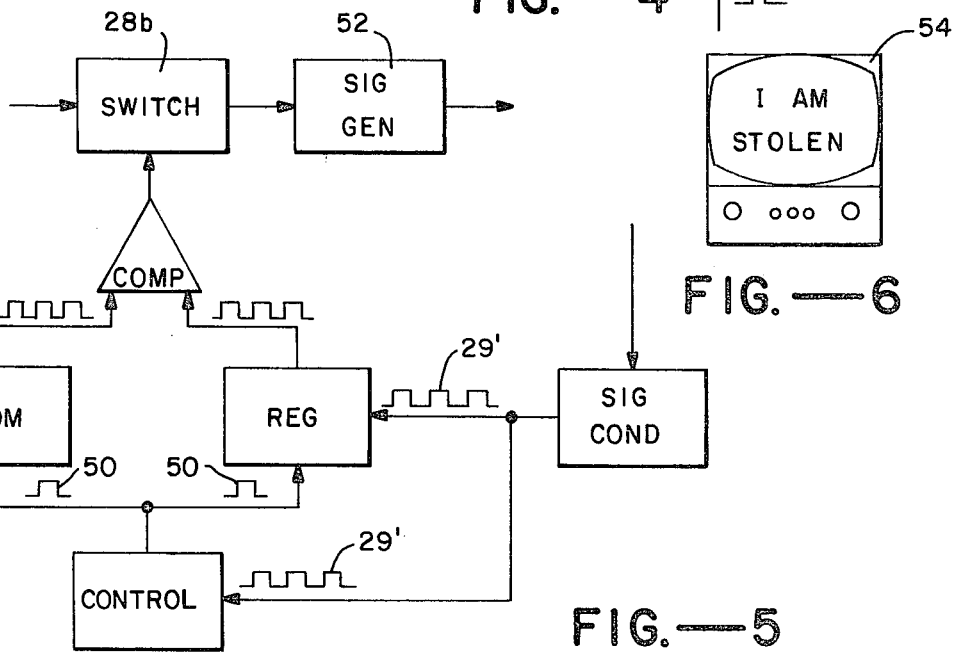
FIG.—6
FIG.—5

PROTECTION SYSTEM FOR ELECTRONIC GEAR

REFERENCE TO PRIOR APPLICATION

This is a Continuation-in-Part of U.S. patent application Ser. No. 726,273, now abandoned, filed Sept. 24, 1976.

BACKGROUND OF THE INVENTION

The incident of theft of electronic gear including units such as citizens' band radios (CB) and high fidelity audio systems (hi-fi) has become a problem of major importance, both to the owners and manufacturers and sellers of such units. Thefts from the home of owners of electronic gear is on the increase, and the theft of CB's from vehicles has approached epidemic proportions, as evidenced by widespread cancellation of insurance on CB gear.

There have been advanced various ideas to protect personal property from theft, but the very nature of electronic gear or components thereof has frustrated the success of these ideas with respect thereto. Marking or registration of this type of equipment is not normally a sufficient deterrent, because the valuable portions thereof are seldom visible, and the cupidity of at least portions of the general public defeats the purpose of marking or registration.

The majority of thefts of privately owned electronic equipment or gear is accomplished by persons having little or no technical knowledge of electronics, and the course of "commerce" therein is seldom peopled by anyone with technical electronic capability. Consequently, a "built-in" fault in electronic gear presents a major obstacle to the movement of same in underworld commerce or the use of same by utlimate unconscionable purchasers.

The present invention provides a theft protection system which may even be "advertised" on the face of the gear protected thereby, and which in many instances will lead to the recovery of the gear, but at least will render the gear unuseable by a thief.

SUMMARY OF THE INVENTION

The present invention is directed to attachment to or inclusion in the circuit of electronic equipment or gear to be protected by the invention. There is provided hereby a free running audio oscillator which is energized each time that power is applied to the protected system. The output of this oscillator is employed to apply a predetermined audio signal upon the RF modulated signal of a transmitter of the protected gear or to superimpose the audio signal thereof on an output of the gear.

The present invention also includes means for disabling the audio oscillator of the system, and such means preferably include means for storing a unique disable signal, coincidence means for comparing an input disable signal to the stored disable signal, and means preventing output of the audio oscillator upon coincidence of input and stored disabled signals.

To the user of the present invention it is necessary to input or apply to the system a personalized, coded signal before using the system. This personalized signal must be employed or the device will emit a "theft" signal. Equipment so protected and which includes a transmitter will transmit a distinctive theft signal that may, for example, conform to international code, so that upon use of a stolen system or piece of gear it is possible with a radio direction finder to actually locate the gear. Equipment having only a local audio amplifier will broadcast at least an interference signal through the speaker or speakers thereof, so as to render the equipment unuseable.

The present invention provides for the storage of a personalized disable signal in the read only memory unit (ROM) incorporated in the present invention. Field programming units are well known for inserting information into ROMs and such units may even be provided for use at sales outlets, so that the purchaser of electronic gear incorporating the present invention may have his personalized disable code inserted in the ROM of the system. Such a code might, for example, comprise the Social Security number of the purchaser or any other desired combination of numbers, words, tones or identifiable indicia comprising, in combination, a unique or substantially unique combination.

DESCRIPTION OF FIGURES

The present invention is illustrated as to preferred embodiments thereof in the accompanying drawing, wherein:

FIG. 3 is a more detailed block diagram of the system illustrated in FIG. 1, specifically illustrating certain possible modifications thereto.

FIG. 4 is a block diagram of a part of a system in accordance with another embodiment of the present invention.

FIG. 5 is a block diagram of a part of a system in accordance with still another embodiment of the present invention.

FIG. 6 is a front elevational view of a television set which may be protected by the present invention.

DESCRIPTION OF PREFERRED EMBODIMENTS

The present invention, as noted above, provides for generation and emanation of an alarm or theft signal by and from electronic gear such as a CB radio, a stereo system or the lie, in the absence of an input disable signal known only to the owner of the equipment. The invention thus provides protection of electronic gear or equipment from theft. Electronic gear such as a radio protected by the present invention will automatically transmit a theft signal over the airwaves, for example, unless the specific disable signal applicable to that set is applied to the set when the power is turned on. Electronic gear which does not incorporate a transmitter will apply an interference signal to the output thereof, whether audio or otherwise, unless the specific disable signal of the protected system is applied to the system when the power is turned on.

Figure 1:
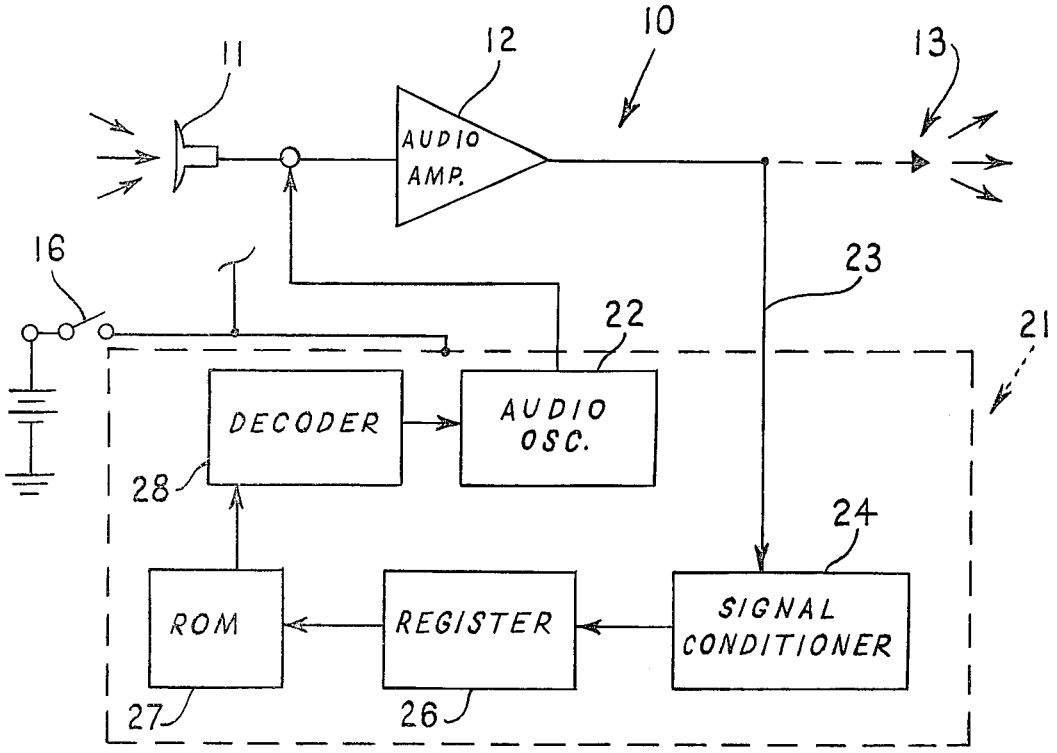
FIG. 1 is a block diagram of a system in accordance with one embodiment of the present invention.

Reference is now made to the drawings showing a number of simple examples of the present invention, and noting first FIG. 1 thereof, there will be seen to be shown an electronic system 10 having an audio input in the form of a pick-up or microphone 11 which is connected to an audio amplifier 12 that in turn applies the output thereof through appropriate circuitry to an output 13 such as the antenna of a radio transmitter. The system of the present invention, as generally included within the dashed line 21 of FIG. 1, includes a free-running audio oscillator 22 having the output thereof connected to the input of the audio amplifier 12. The system and all of the elements thereof within the dashed line 21 is energized through a main power supply switch 16 of the gear 10 from a power supply 17 so that the system is automatically energized every time the gear is energized. In this regard, while switch 16 and supply 17 are shown only in circuit with system 21 (FIG. 1) and specifically with audio oscillator 22 (FIG. 3) through a relay switch to be discussed, it is to be understood that both are used to supply and switch on and off power to system 10. Moreover, while not shown in FIGS. 1 and 2, each component making up system 21 may be powered by supply 17 through switch 16. The audio oscillator of the system 21 is arranged to produce a predetermined audio signal, herein termed "theft signal", which will be seen to be normally applied to the input of the system audio amplifier 12, so as to comprise a portion of the output of the protected system.

The system 21 of the present invention also has an input thereto connected to the output of the audio amplifier 12 as designated by an input line 23 which is connected to the input of a signal conditioner 24 in the present invention. The system 21 further includes a register 26 connected to the output of the signal conditioner 24 and applying the register output to one input of a decoder 28 and the system also includes a read-only memory unit (ROM) 27. This ROM may comprise a commercially available unit into which a particular signal combination word or code may be inserted, and which is subsequently retained therein. The ROM 27 is herein employed to store a unique disable code and is, as shown, connected to a second input of the decoder 28 wherein a coincidence at the decoder inputs of an input code through the conditioner and register and the stored code in the ROM will produce a disable signal which is applied to the audio oscillator 22 for terminating the output thereof, as will be discussed in more detail hereinafter. For the moment, it suffices to say that in the embodiment illustrated in FIG. 1, both the stored code and the input code can be a digital code (a series of high and low outputs). Moreover, in this embodiment, both the ROM and register have parallel outputs so that the entire code from the ROM is applied at once to the decoder 28 and so that the entire code from the register is applied at once to the decoder.

Considering the operation of the present invention somewhat further, it is noted that the invention is adapted to receive an input signal from the output of the audio amplifier 12 in the system to be protected. This input signal may include a disable code which is intentionally applied to the system to be protected as, for example, by means of the application of a particular sequence of tones to the microphone. If the signal on input line 23 includes the disable code, it will be conditioned by the conditioner 24 and applied to the register 26 where it will be stored temporarily and applied to the decoder 28. If this disable code is the same as the code stored in the ROM 27, the decoder 28 will produce a coincidence signal that is applied to control, i.e. turn off, the output of the audio oscillator 22. It is only under the circumstance wherein the system 21 receives the ROM stored disable code that the audio oscillator 22 is disabled. In the absence of an input disable code to the system 21 the audio oscillator automatically applies a theft signal to the input of the audio amplifier 12, so that this theft signal then constitutes a portion of the output of the system to be protected.

The disable code for the present invention may be applied to the system hereof in a variety of different ways. Thus, for example, a signal which passes through the audio amplifier 12 of the protected system will, in accordance with the circuitry of FIG. 1, be automatically applied to the present invention. Such signal may, as noted above, comprise a particular succession of musical tones (generally indicated at 29 in FIG. 3) that may be impressed upon the microphone 11 as by whistling or manipulation of the microphone switch as by multiple depressions of the "push to talk" button.

Figure 2:
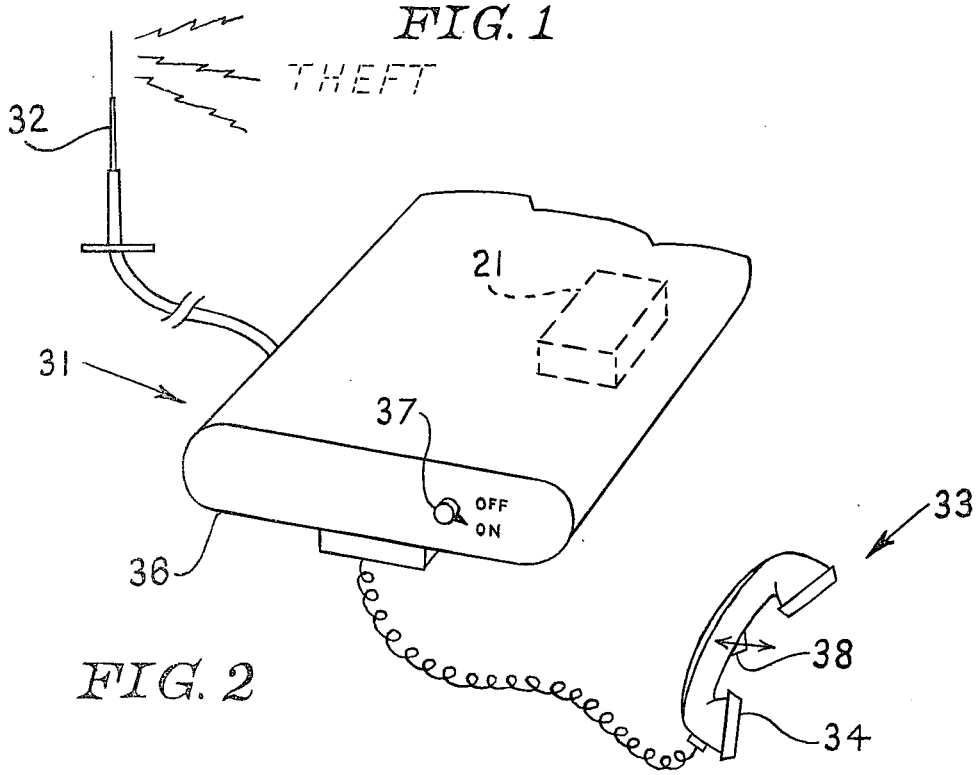
FIG. 2 is a pictorial representation of a CB radio as may be protected by the present invention.

In FIG. 2 there is pictorially illustrated a CB radio 31 having an antenna 32 and a handset 33 incorporating an input microphone 34. The present invention may be structurally incorporated in the CB radio 31 merely by the insertion of a small unit 21 in the radio housing 36, and electrically connecting the unit 21 as indicated in FIG. 1. The unit of the present invention may have a very small physical size, for the entire unit may be readily incorporated upon a small printed circuit board with suitable connections to the on and off switch 37 of the radio and to the input and output of the audio amplifier of the radio. A conventional CB radio has a "push to talk" button 38 normally mounted on the handset 33, so that an operator may operate this button 38 to apply a predetermined sequence of signals to the audio amplifier 12 of the radio. This sequence of signals, as determined by operation of the button 38, may comprise the disable code stored in the ROM 27 of the present invention. A coincidence between such an input and stored signal will disable the audio oscillator 22. Application of any other signals, either through the microphone 34 or by means of the button 38, will not produce a coincidence in the system of the present invention and, consequently, the oscillator output will be continuously applied to the input of the audio amplifier 12 of the radio, so that a theft signal will be broadcast from the antenna 32 as pictorially indicated in FIG. 2 of the drawings. This broadcast signal may, in fact, say "theft" or "stolen" or, alternatively, may comprise a "theft" signal superimposed upon the other information broadcast in the form of a coded transmission approved by appropriate authorities. It is only necessary for the citizen band wavelength to be monitored in order to receive the theft signal and, of course, it is possible with a radio direction finder to them locate the stolen radio.

Application of the present invention to electronic gear which does not include a transmitter will cause the theft signal of the present invention to be imposed upon the output of such gear whether it be audio or otherwise. Generally, such a theft signal may preferably comprise an interference signal of sufficient magnitude to render the equipment useless. While such a theft signal is not broadcast, it will prevent further use of the system without electronic modification to disconnect the present invention from the equipment or gear being protected thereby. It will be appreciated that an almost unlimited number of different disable codes are possible for even a minute ROM unit is capable of storing a very large number of different combinations of signals. At least many millions of different combinations are possible with a very small and inexpensive ROM. The capability of permanently setting the condition of the ROM, i.e., inserting the disable code, is readily available and is, in fact, widely employed in industry. So-called field programmers are commonly employed with what are generally termed "field programmable memory units" which are, in fact, ROMS. It will be appreciated that information such as the disable code is stored in the ROM in binary language, and the conditioner and register of the present invention provides for the application of the disable code to the ROM in proper form for comparison with the code as stored therein. No attempt is made herein to provide circuit details of elements illustrated in the block diagram of FIG. 1, inasmuch as these are well known in the art.

It will be seen from the foregoing description of a preferred embodiment of the present invention that the invention is particularly adapted to the protection of electronic gear from theft. Any type of electronic gear, including an audio amplifier for example, may be readily protected by connection of the present invention to the gear internally thereof. While it might be possible for an electronic technician to investigate the internal connections of the gear and consequently to disconnect the present invention, it is again noted that such a capability is normally well beyond those who steal commercial electronic equipment such as CB radios, hi-hi sets and the like. The present invention may, however, be integrated at least in part into the gear 10 so that it is substantially impossible even for an electronic technician to disarm the invention. In the illustrated embodiment of the invention, one or more of the circuits within the system 21 may be physically incorporated as a part of an integrated circuit audio amplifier 12 of the gear 10 so that separation thereof is almost impossible. It will also be noted that the present invention need not include particular circuits such as described and illustrated for the generation and application of the theft signal may be alternatively accomplished as, for example, merely by interrupting the output of the electronic gear.

It will also be appreciated that a system protected by the present invention will produce a theft signal if the operator inadvertently fails to insert the disable code. However, this is similar to most protection systems, and is not considered a limitation of the present invention. It would, of course, be possible, if desired, for transmitting equipment to include an audio or visual indication of the transmission of the theft signal in order to warn an operator that he has failed to disable the alarm system.

Having described overall system 21 and the way in which it operates with respect to FIGS. 1 and 2, attention is now directed to FIG. 3. As stated previously, the various individual components making up the system are powered by means of main supply 17 through switch 16, both of which, as also stated, comprise part of overall system 10, that is, the electronic gear to be protected. In this regard, where necessary, system 21 may include an appropriate power regulator (not shown), for example a step-down transformer or the like, in the event that the main power supply is not in and by itself compatable with the components making up system 21. Moreover, it is to be understood, as stated, that each of the components making up system 21, as illustrated in FIG. 1, are conventional and may be readily provided by those with ordinary skill in the art. The particular ways in which these components cooperate with one another have been described above with respect to FIGS. 1 and 2 and a more detailed discussion will be provided with respect to FIG. 3.

Turning specifically to FIG. 3, decoder 28 is shown including a conventional multi-input comparator **28*a* (two groups of three inputs in the embodiment illustrated) and a switch 28*b* which may be, for example, an electromagnetic relay having a normally closed contact. This decoder may also include a conventional delay circuit indicated generally by dotted lines at 28*c*. The way in which these components operate to disable audio oscillator 22 will be discussed below. For the moment, it suffices to say that a coil (not shown) comprising part of relay switch 28*b* is connected in circuit with the output of comparator 28*a* and with ground (not shown). Its normally closed contact is located in series circuit with the input of audio oscillator 22, switch 16 and power supply 17. In this regard, if a delay circuit is used, it is also connected in series circuit with the input of audio oscillator 22 and the relay switch 28*b***, as shown.

Operationally, the main gear is turned on by closing switch 16. Power is immediately applied from supply 17 to the input of audio oscillator 22 through the normally closed contact of relay switch **28*b* for powering the oscillator. This is of course assuming that the delay circuit 28*c* is not used. If this latter circuit is included in system 21, it maintains the circuit between battery 17 and the input of audio oscillator 22** opened for a predetermined period of time to allow the operator to disable the oscillator, if he has the appropriate code.

At the same time power is applied to oscillator 22, as a result of closing switch 16, power is also appled to ROM 27 (by lead wires not shown). This automatically causes the ROM to apply its precoded digital signal, generally indicated at 40 in FIG. 3, to one input (or group of inputs) of comparator **28*a*. In this regard, it is noted that the ROM illustrated has a parallel output so that all of the digits of code 40 are applied to corresponding inputs of comparator 28*a* at once. Moreover, the ROM may be of a one-shot type which applies coded signal 40 to the comparator to be stored until a matching signal is applied to its other input, as illustrated in FIG. 3, or it may be a free-running type of ROM which continuously applies a coded signal 40 to comparator 28*a***, as will be discussed hereinafter.

In order to disable audio oscillator 22, a signal identical to signal 40 must be applied to the other inputs of comparator **28*a*. As discussed previously, this may be accomplished by presenting an audio signal, appropriately coded, to system 21 through for example microphone 11. This, in turn, produces an analog signal 29 (illustrated in FIG. 3) which is ultimately converted to a digital signal 29' by means of signal conditioner 24, which, in this case, acts as an analog-to-digital converter. Signal 29' is applied to the input of register 26 which applies the appropriate pulses (highs and lows) at appropriately spaced durations to the input of comparator 28*a*. Note that the output of register 26, like ROM 27, in the embodiment illustrated, is parallel so that the digits making up signal 29'' are applied to comparator 28*a* at the same time. If this latter signal 29'' is identical to signal 40, then comparator 28*a* produces a disabling signal 42 at its output. In this regard, if ROM 27 is free-running as discussed previously and the comparator has no latching capability (for holding signal 40), in order for the comparator to produce an output, signal 29'' will have to be applied to the comparator coincidentally with signal 40**. This may mean that the operator may have to try a number of times until the two signals are synchronized.

The ouput signal 42 is used to energize the coil of relay switch **28*b* for opening its normally closed contact which is in the power line from battery 17 to audio oscillator 22** for opening the circuit and cutting off power to the oscillator for disabling it. In this regard, while comparator 28*a* can be of the type which provides a continuous output for maintaining the coil of relay switch 28*b* energized, in a preferred embodiment, switch 28*b* is of a latching type which requires a single pulse 40 for opening the circuit between battery 17 and the oscillator. This switch could for example include a latching relay, a flip-flop or the like which returns to its initial state upon a subsequent power shutdown.

In the particular embodiment illustrated in FIG. 3, decoder 28 is shown to include a comparator and a switch, specifically a relay switch, and possibly a delay circuit. It is to be understood however, that the decoder utilized in the present invention is not limited to this particular structure but may be readily designed in any suitable way so long as it functions in the manner described, that is, to disable audio oscillator 22 by producing an appropriate signal.

It is to be noted that the signals applied to the inputs of decoder 28, that is, precoded input signal 40 from ROM 27 and actuated input signal 29″ from register 26 are digital signals having highs (ones) and lows (zeros). Since the embodiment illustrated in FIGS. 1 and 3 utilizes a single input (for example microphone 11) to produce signal 29 and ultimately to produce signal 29″, the signal entering register 26 may vary depending upon how quickly or slowly the operator produced the signal at microphone 11. For example, let it be assumed for the moment that the coded signal required to disable audio oscillator 22 is a logic one (1), followed by a logic zero (0) and then another logic one (1). Obviously, the operator is not going to be able to shout or whistle into the microphone 11 followed by a pause and then another shout or whistle to produce the coded signal with high consistency from one time to the next. Accordingly, register 26 must include an appropriate timer for discriminating between consecutive ones and consecutive zeros as opposed to ones followed by zeros or zeros followed by ones. This requires the operator to either make some sound or no sound in a certain period of time to produce a logic one or zero.

This would be equally true if signals 29′ and 29″ were produced as a result of closing a switch. This is illustrated by dotted lines in FIG. 3. More specifically, as seen in this figure, push button 44 (which may correspond to button 37) is connected in circuit to a lead 46 which is connected between the power supply, switch 16, and an input to signal conditioner 24. Once switch 16 is closed, the push button can be operated to produce the digital signal 29′ (comparable to analog siganl 29) which is conditioned by conditioner 24 so as to produce output signal 29′. In this case, the signal conditioner would not be operated as an analog to digital converter but rather as means for smoothing out input signal 29*a*. So long as the operator depresses button 44 and releases the button within appropriate time limitations to produce the appropriate coded signal 29′, register 26 will produce the corresponding output signal 29″. In this case, note that the register acts as a series to parallel converter for converting series signal 29′ to parallel signal 29″.

In order to avoid the problem of timing the input signal 29 or 29*a* which is required with a single input type approach, a double input approach could be utilized. This is best illustrated in FIG. 4 where both input signals 29 and 29*a* are utilized and applied to a signal conditioner 24′. In this case, each pulse in the signal 29 could represent a one and each pulse in the signal 29*a* could represent a zero. Accordingly, by first whistling into the microphone and then depressing and releasing button 44 and finally whistling again into the microphone, the signals illustrated at the output of the signal conditioner in FIG. 4 can be produced. These signals can be applied to a double input register which discriminates between the two for producing at its output a one followed by a zero and then a one, which corresponds to the three digits applied to the signal conditioner. In this way, the register 26′, unlike register 26, does not require clock or other suitable type of timing mechanism and the operator does not need to feel rushed as he presents the coded signal to system 21. It is to be understood that the system as modified in FIG. 4 is not to be limited to signals corresponding to analog signal 29 and digital signal 29*a* but could, for example, readily include two buttons or possibly two separate microphone input.

As state previously, ROM 27 may be one which produces a single output 40 and comparator 28 may be one capable of storing this signal until receipt of signal 29″. While this appears to be the most uncomplicated and economical way to disable audio oscillator 22, it is possible to use a free-running ROM, that is, one which continuously produces signal 40 at its output for application to the input of comparator 28*a* when switch 16 is closed. As also stated previously, this may require signals 40 and 29″ to be applied coincidentally to comparator 28*a*. However, this can be avoided by providing the overall system with some type of means to synchronize signal 40 with signal 29″, so that the comparator compares the two signals under appropriately synchronized conditions. As illustrated in FIG. 5, signal 29′ which, as stated previously, is applied to the input of register 26, is also applied to a control circuit 48. This control circuit is provided for producing a synchronization signal 50 at its output in response to the presence of signal 29′ at its input. The control circuit may include means for delaying the production of synchronization signal 50 in order to allow the entire signal 29′ to enter the register. In any event, synchronization signal 50 is simultaneously applied to the input of the ROM and the input of the register for simultaneously applying previously discussed signals 40 and 29″ to the inputs of the comparator (or decoder generally) for disabling audio oscillator 22. In this regard, it may be noted that both the ROM and register may include series outputs so that the digits of signals 40 and 29″ are applied successively (but in synchronism with each other).

The overall system 21 illustrated in FIGS. 1 to 3 and the various modifications illustrated in FIGS. 4 and 5 have all presupposed that the ultimate signal produced would be an audio signal. As illustrated in FIG. 5, power supplied out of switch 28*b* is supplied to a signal generator generally, which is designated by the reference numeral 52. This generator may be an audio oscillator (specifically audio oscillator 22) or it may also produce a signal for interfering with the gear to be protected in other ways. For example, were the gear to be protected is a television set which is generally illustrated in FIG. 6 at 54, signal generator 52 may include a word generator appropriately connected into the television circuitry for producing the words "I am stolen" across the screen regardless of what channel the TV is operating on. Obviously, this particular word generator or the signal generator in general could be used in any of the embodiments described herein.

System 21 and its various modifications can be incorporated into existing electronic gear or it can be manufactured into the gear as the latter is manufactured. If the latter is the case, it is preferably to have the circuitry of system 21 intergrally incorporated into the circuitry making up the gear itself. In this way, it is difficult if not impossible to circumvent the purpose of the present invention by deleting the warning system or any of its components without otherwise damaging the overall gear.

Although the present invention has been described above with respect to a number of preferred embodiments thereof, it will be appreciated that numerous modifications and variations may be made within the scope of the present invention, and thus it is not intended to limit the invention to the details of illustration or precise terms of description.

What is claimed is:

1. A protection system for electronic gear having an output comprising:

an audio oscillator connected for energization with said gear to produce an audio theft signal and having an output thereof coupled to the output of said gear, a memory unit adapted to store and produce a disable code reference signal, input means connected to receive input signals applied to said electronic gear including a disable code input signal, decoding means connected to said memory unit and said input means for producing an output signal upon coincidence of the disable code reference signal stored in said memory unit and said disable coded input signal received from said electronic gear, and means connected with the output of said decoding means and with said audio oscillator for disabling said audio oscillator in response to said output signal.

2. The protection system of claim 1 further defined by said memory unit comprising a read-only memory.

3. The protection system of claim 1 further defined by said input means being connected from the output of said gear to said decoding means whereby the latter receives said input signals from the output of said gear.

4. The protection system of claim 1 further defined by said input means comprising a signal conditioner having an input thereof connected to said electronic gear, and a register connected between an output of said signal conditioner and an input of said decoding means.

5. A protection system for electronic gear operating between an energized and de-energized state and having electrical circuit means providing an electrically produced output, said system comprising:

signal means adapted for connection with said gear for automatically generating and applying a theft signal to said circuit means of said electronic gear in response to the energization of said gear from its de-energized state for distorting said output, means for producing input signals including a predetermined input signal, and control means connected with said input signal producing means for receiving said input signals, said control means being connected to said signal means for disabling the latter upon receipt of said predetermined input signal for preventing application of said theft signal to the circuit means of said electronic gear.

6. The protection system of claim 5 wherein said signal means includes an audio oscillator and said theft signal is an audio signal.

7. The protection system of claim 5 wherein said gear is a television, wherein said signal means includes a word generator and wherein said theft signal is produced at the output of said generator and adapted for providing a predetermined visual display on the screen of said television.

8. A protection system for electronic gear operating between an energized and de-energized state and having electrical circuit means for producing input signals including a predetermined input signal and providing an electrically produced output, said system comprising:

signal means adapted for connection with said gear for automatically generating a theft signal in response to the energization of said gear from it de-energized state, said signal means also being adapted for connection with said electrical circuit means for applying said theft signal to said circuit means for at least distorting its output, and control means adapted for connection with said gear to receive said input signals from the latter and connected to said signal means upon receipt of said predetermined input signal for preventing application of said theft signal to said circuit means of said electronic gear.

9. The protection system of claim 8 wherein said theft signal is generated upon energization of said gear.

10. The protection system of claim 8 wherein said theft signal is applied to said gear for completely eliminating its normal output.

11. A protection system for electronic gear including means for producing input signals including a predetermined input signal and having an output and power supply connections, said system comprising:

signal means including a normally operable signal generator connected with said gear for energization therewith from said power supply connections and connected to said output for automatically applying a theft signal to the output of said electronic gear in response to the energization of said gear, and control means adapted for connection with said gear to receive said input signals and connected with said signal means to disable said generator upon receipt of said predetermined input signal from said gear for preventing application of said theft signal to the output of said electronic gear, and control means including a memory unit adapted to permanently store and produce a disable code signal, and means connected to said memory unit and said input signal producing means for disabling said normally operable signal generator upon a coincidence of said input and stored signals.

12. The protection of claim 5 wherein said signal means includes means for generating and applying said theft signal a predetermined period of time after energization of said gear unless said signal means is disabled prior thereto.

13. The protection system of claim 8 wherein said signal means includes means for generating and applying said theft signal a predetermined period of time after energization of said gear unless said signal means is disabled prior thereto.

* * * * *